US006935737B2

(12) United States Patent
Kanome et al.

(10) Patent No.: US 6,935,737 B2
(45) Date of Patent: Aug. 30, 2005

(54) INK JET RECORDING APPARATUS

(75) Inventors: Yuji Kanome, Yokohama (JP); Atsuhiko Masuyama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/212,747

(22) Filed: Aug. 7, 2002

(65) Prior Publication Data

US 2003/0035039 A1 Feb. 20, 2003

(30) Foreign Application Priority Data

Aug. 10, 2001 (JP) ..... 2001/243646

(51) Int. Cl.[7] ..... B41J 29/38; B41J 2/01

(52) U.S. Cl. ..... 347/104; 347/9; 347/16; 399/315

(58) Field of Search ..... 347/104, 101; 400/701, 702; 399/315; 101/416.1

(56) References Cited

U.S. PATENT DOCUMENTS 4,095,233 A * 6/1978 Goffe ..... 347/98
4,918,464 A * 4/1990 Isshiki ..... 347/215
4,994,861 A * 2/1991 Brandon et al. ..... 399/315
5,339,144 A * 8/1994 Nakai et al. ..... 399/66
5,517,222 A * 5/1996 Sugiyama et al. ..... 347/35
5,633,703 A * 5/1997 Takenouchi et al. ..... 399/315
5,821,968 A * 10/1998 Ohyama et al. ..... 347/104
5,854,648 A * 12/1998 Hanabusa ..... 347/104
5,929,888 A 7/1999 Kawamura
6,004,052 A 12/1999 Muranaka
6,048,060 A * 4/2000 Narushima et al. ..... 347/104
6,076,917 A * 6/2000 Wen ..... 347/43
6,168,259 B1 * 1/2001 Capurso ..... 347/36
6,198,492 B1 * 3/2001 Wakahara et al. ..... 347/141
6,198,900 B1 * 3/2001 Wakahara ..... 399/313
6,217,167 B1 * 4/2001 Wen et al. ..... 347/101
6,239,817 B1 * 5/2001 Meyer ..... 347/36
6,309,063 B1 * 10/2001 Kamano et al. ..... 347/104
6,511,172 B2 * 1/2003 Tanno et al. ..... 347/104
2002/0034405 A1 * 3/2002 Kayahara et al. ..... 399/297

FOREIGN PATENT DOCUMENTS

EP 0 636 486 2/1995
JP 57-174268 10/1982

* cited by examiner

*Primary Examiner*—Lamson Nguyen
*Assistant Examiner*—Leonard Liang
(74) *Attorney, Agent, or Firm*—Fitzpatrick, Cella, Harper & Scinto

(57) ABSTRACT

An ink jet recording apparatus, for effecting recording on recording sheets by ejecting ink from a recording head onto the recording sheets, includes a head carrying portion for carrying the recording head; a feeding roller for separating and feeding recording sheets one by one from a plurality of the recording sheets; a conveying roller for conveying the recording sheet fed by the feeding roller to a position where the recording sheet is opposed to the recording head; and a discharging unit disposed between the feeding roller and the conveying roller with respect to a feeding direction of the recording sheet. The discharging unit is effective to decrease an electrostatic charge amount of the recording sheet to a level lower than a predetermined level.

18 Claims, 12 Drawing Sheets

INK JET RECORDING APPARATUS

FIELD OF THE INVENTION AND RELATED ART

The present invention relates to an apparatus and method for effecting recording by ejecting ink onto a recording material (recording sheet).

In this specification, "recording" ("print") is not limited to the recording or printing of significant information such as characters, figures or the like, but widely covers recording or printing of an image, pattern or the like on a print medium and processing of the medium, irrespective of whether or not they are significant or insignificant and irrespective of whether or not they are visualized to be sensed by the visual sense of a person.

The "recording sheet" is not limited to a sheet of paper but covers textile, plastic resin material, film, metal plate or the like, or glass, ceramic, wood, leather or the like as long as it can receive the ink.

The "ink" ("liquid") is not limited to usual ink, but covers liquid which can form an image, pattern or the like or process the recording sheet by being applied on the recording sheet and the liquid used for processing the ink (coagulation or insolubilization of the coloring material in the ink applied on the recording sheet).

An ink jet type recording device (ink jet recording apparatus) is known as a recording device usable as an output equipment of a computer, a word processor, a combination type electronic equipment including them, a work station or the like. In the ink jet recording apparatus, the ink is ejected from the recording head onto the recording material to effect the recording, and it is advantageous as follows.

The recording head can be easily downsized; high quality images can be printed at a high speed; plain paper is usable as the recording sheet; and the running cost is low. It is of non-impact type, and therefore, the noise is low, and in addition, color image recording is easy using multi-color inks. By using a line type recording head structure in which a number of nozzles are arranged in a widthwise direction of the recording paper, the recording speed is further increased.

The ink jet recording apparatus is classified into a plurality of groups depending on the mechanisms for ejecting the ink, that is, depending on the difference in the structure of the recording head. Among them, the type using a recording head ejecting the ink using thermal energy is advantageous in that the recording head is further downsized by providing a high density liquid passage disposition (nozzle disposition) using electrothermal transducers formed on a substrate, electrodes, liquid passage walls, and a top plate or the like which can be manufactured through a semiconductor manufacturing process including an etching, evaporation, sputtering or the like.

Such an ink jet recording apparatus is usually provided with a sheet feeding apparatus for automatically feeding the recording sheet to the recording station. The sheet feeding apparatus includes a sheet accommodating portion such as a sheet supporting tray, a sheet supporting deck, a removable type sheet cassette, or a manual insertion tray. One or more recording sheets are accommodated in the sheet accommodating portion, from which the sheets are fed to a sheet processing portion such as an image formation station, an exposed portion, a process portion or the like.

A sheet feeding apparatus of conventional separating-type is a means for separating the sheets and feeding the recording sheets in seriatim. Such a sheet feeding apparatus includes a feeding roller as feeding means, a separation pad as separating means, for singling a sheet out of a number of stacked sheets, a pressing plate for pressing the sheet to the feeding roller by urging force of a spring during supply of the sheet, and a base member. A leading edge of the sheet is regulated by a stopper provided on the base, and the lateral sides of the sheets are regulated by a movable side guide mounted on the pressing plate and the guide portion of the base member.

FIG. 12 is a schematic illustration of a conventional separating-type ink jet recording apparatus. The ink jet recording apparatus comprises a sheet feeder for feeding the recording sheets one by one, a feeding portion for feeding the recording sheets from the sheet feeder to the recording station, a recording station including a recording head 206 for effecting recording on the recording sheet fed by the feeding portion, and a sheet discharge portion including sheet discharging rollers 207 for discharging the recording sheet fed from the recording station to the outside of the apparatus.

The feeding portion includes a sheet stacking portion 200 on which a plurality of recording sheets 201 are stacked, a separation pad (unshown) as the separating means for singling out the recording sheet 201 and feeding it from the sheet stacking portion 200, and a sheet feeding roller 202 (feeding roller). The feeding portion includes a LF roller 203 for feeding the recording sheet 201, separated and fed by the sheet feeding roller 202, into the recording station, a platen 204 disposed opposed to the recording head 206, and a platen absorbing material 205 disposed at such a portion of the platen 204 as to be opposed to the ejection outlets of the recording head 206.

In the conventional ink jet recording apparatus, the recording sheet 201 is picked up one by one from the sheet stacking portion 200 by rotation of the sheet feeding roller 202. The picked recording sheet 201 reaches the LF roller 203, the leading edge of the sheet is aligned, and thereafter, it is fed toward the platen 204 by the LF roller 203. When the leading edge of the recording sheet 201 fed to the platen 204 reaches a predetermined position, the recording operation of the recording head 206 is started. At this time, of the ink ejected from the recording head 206, the ink corning toward the platen 204 outside the recording sheet 201 is absorbed and retained by the platen absorbing material 205.

The recording sheet 201, having been subjected to the recording operation of the recording head 206, reaches the discharging roller 207, and is discharged to the outside of the apparatus by the discharging roller 207.

In such a sheet feeding apparatus, the material of the feeding roller is in many cases chlorinated polyethylene rubber, and the material of the separation pad is in many cases polyurethane. These materials are chosen from the standpoint of assuring the sheet to be singled out irrespective of variations of the ambient conditions such as temperature, humidity, sheet passing hysteresis and the like.

Recently, the recorded image quality of the prints produced by the ink jet recording apparatus has drastically improved to such an extent that the quality is equivalent to a photograph. Additionally, digital image inputting apparatus such as a personal computer, a scanner, a digital camera or the like is widely used, and users can easily produce photographic prints at home. Furthermore, there are increasing needs for frameless prints which do not have white blanks at any of the sides. In order to meet such needs, in the ink jet recording apparatus shown in FIG. 12, the recording operation of the recording head 206 is started slightly before the leading edge of the recording sheet 201 reaches the recording position, and the recording operation of the recording head 206 is stopped after the trailing edge of the recording sheet 201 passes through the recording position. At this time, the same is done with respect to the widthwise direction of the recording sheet 201 (the scanning direction of the recording head), that is, the recording is effected slightly beyond the lateral sides of the recording sheet.

However, in the case that recording is effected beyond the lateral edges of the recording sheet, there arises a problem that ink goes to the back side of the recording sheet (the side opposite from the printing side) particularly under a low humidity ambient condition, and the ink is deposited on the back side, thus contaminating the recording sheet. The main causes of the contamination are: (1) the ink ejected in the area beyond the left and right edges of the recording sheet are scattered and floating adjacent the recording position within the space in the recording device: and (2) the recording sheet is electrically charged by the friction of the recording sheet relative to the feeding roller when the recording sheet is singled out from the stack.

Because of these reasons, the floating ink is attracted electrostatically to the charged portion of the recording sheet resulting in contamination. Particularly, in the case of the conventional separating-type apparatus, the material of the feeding roller is in many cases chlorinated polyethylene rubber, and the material of the separation pad is in many cases polyurethane. These materials are chosen from the standpoint of assuring the sheet to be singled out irrespective of variations of the ambient conditions such as temperature, humidity, sheet passing hysteresis and the like; therefore, the recording sheet is relatively easily charged and easily contaminated.

SUMMARY OF THE INVENTION

Accordingly, it is a principal object of the present invention to provide an ink jet recording apparatus and a method with which a back side of the recording sheet is not contaminated even when the frameless printing is carried out.

It is another object of the present invention to provide an ink jet recording apparatus for effecting recording on recording sheets by ejecting ink from a recording head onto the recording sheets. The apparatus includes a head carrying portion for carrying the recording head, a feeding roller for separating and feeding recording sheets one by one from a plurality of the recording sheets, a conveying roller for conveying the recording sheet fed by the feeding roller to a position where the recording sheet is opposed to the recording head, and discharging means disposed between the feeding roller and the conveying roller with respect to a feeding direction of the recording sheet. The discharging means is effective to decrease an electrostatic charge amount of the recording sheet to a level lower than a predetermined level.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the preferred embodiments of the present invention will be described.

(1) Basic Structure:

The description will be made as to a basic structure of the ink jet recording apparatus according to an embodiment of the present invention. In this embodiment, the printer is an ink jet recording type printer (ink jet printer).

(1-1) Main Assembly of Apparatus

Figure 1:
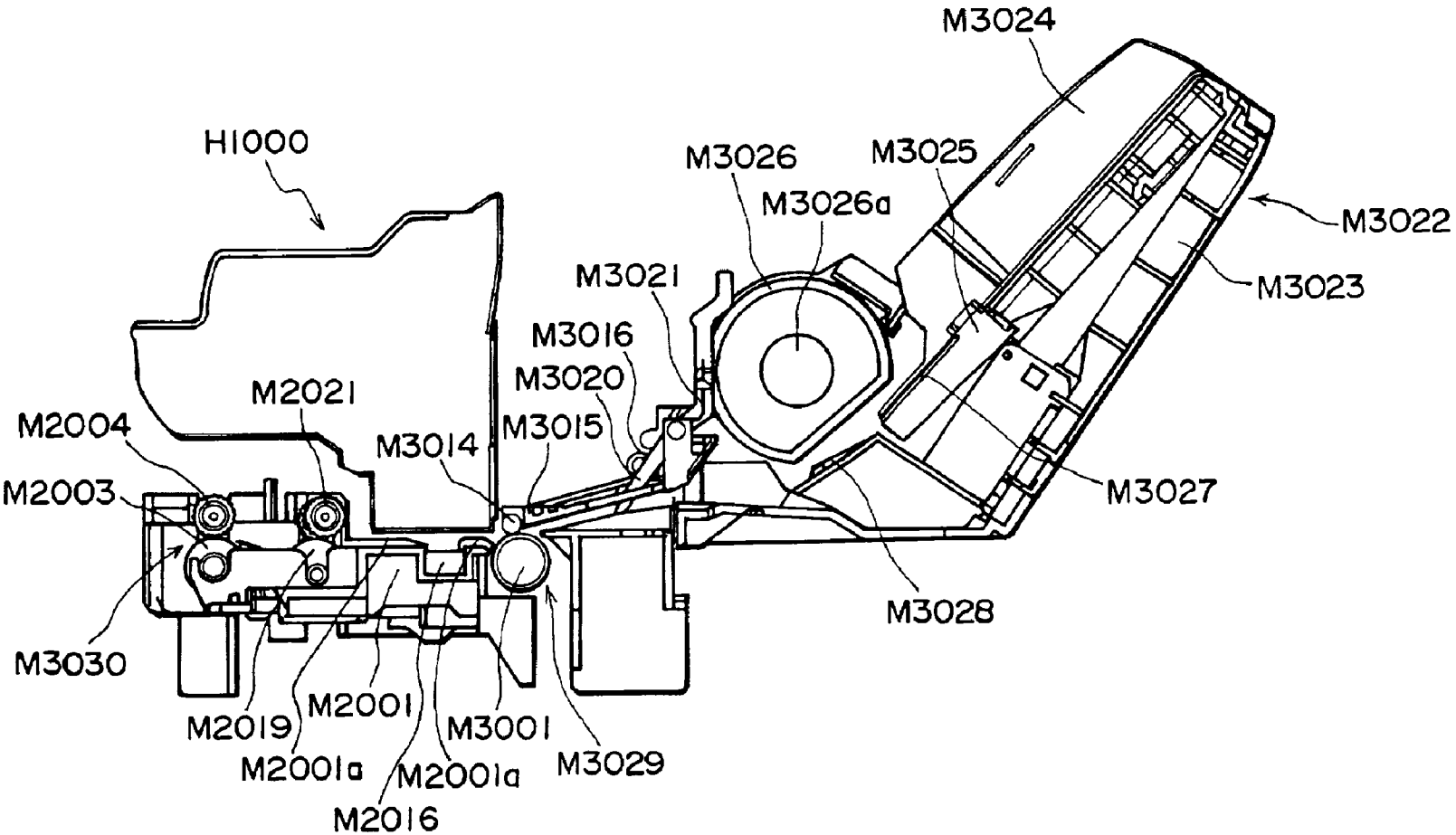
FIG. 1 depicts a schematic side view illustrating a structure in the ink jet printer according to an embodiment of the present invention.
Figure 2:
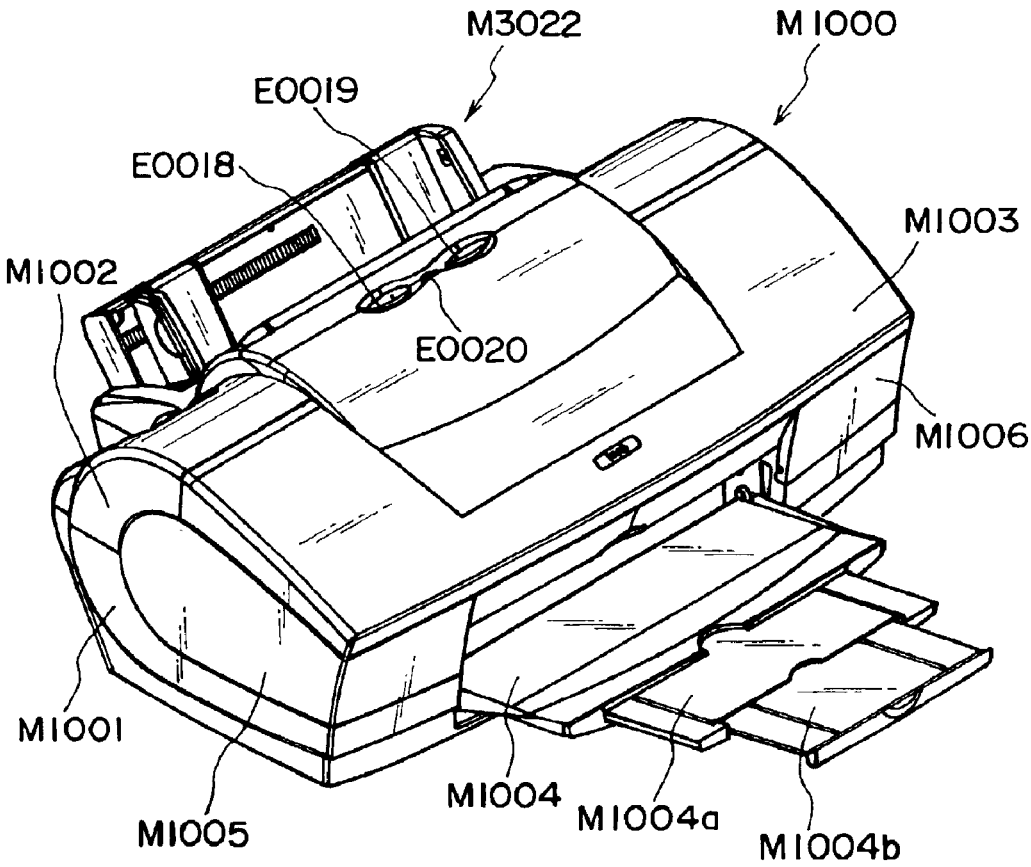
FIG. 2 is an outer appearance of an ink jet printer of FIG. 1.
Figure 3:
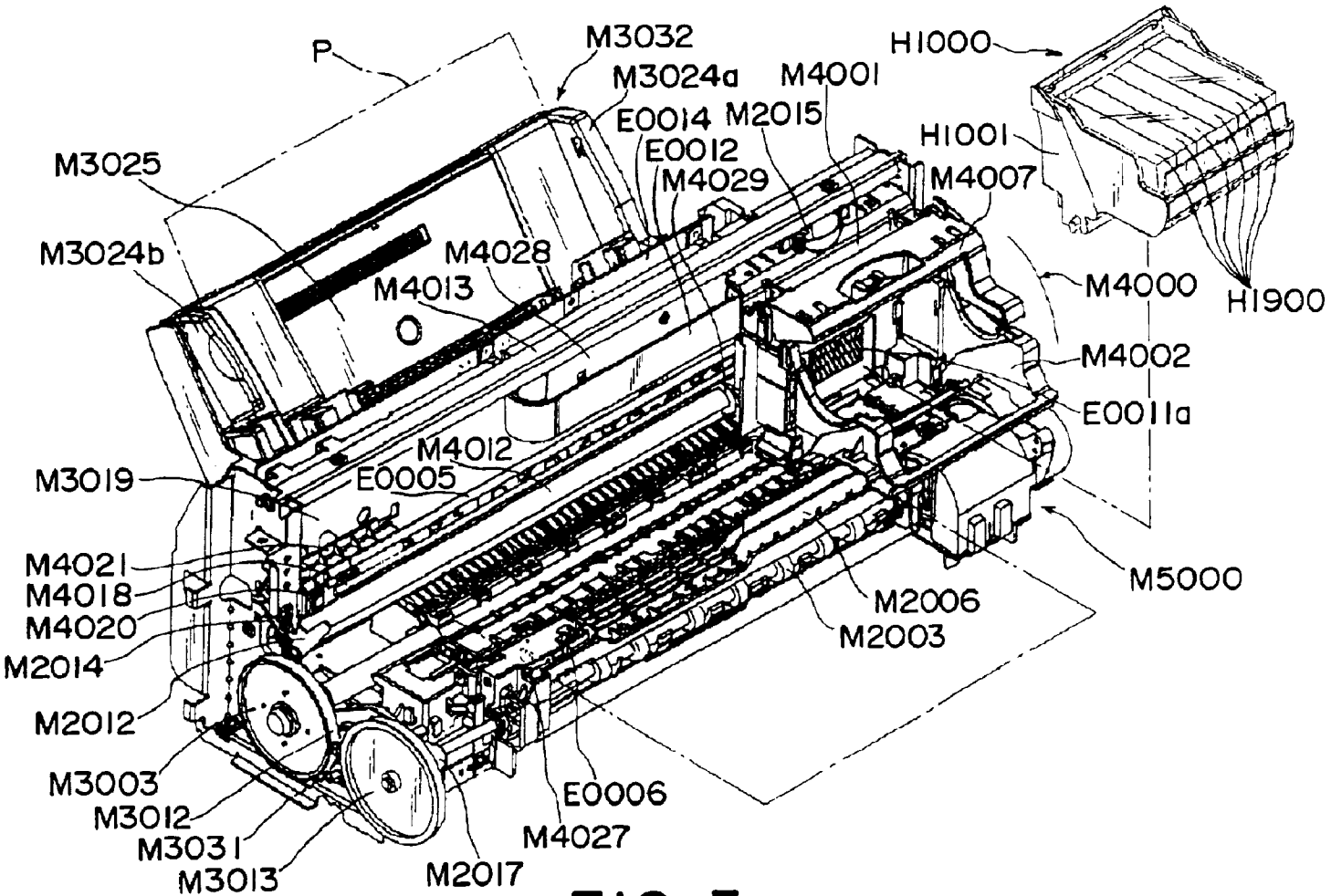
FIG. 3 is a perspective view of an ink jet printer of FIG. 2 from which an outer casing member is removed.

FIG. 2 is an outer appearance of an ink jet printer of FIG. 1, and FIG. 3 is a perspective view of an ink jet printer of FIG. 2 from which an outer casing member is removed.

In these Figures, the main assembly M1000 of the apparatus constituting the outer shell of the ink jet printer comprises a lower case M1001, an upper case M1002, an access cover M1003, a sheet discharge tray M1004, a front cover (L) M1005, a front cover (R) M1006 (outer casing members) and a chassis M3019 accommodated in the outer casing members.

The chassis M3019 is constituted by a plurality of metal plate members having a predetermined rigidity, and forms a skeleton of the ink jet printer to support various parts of the recording operation mechanism which will be described hereinafter. The lower case M1001 constitutes a substantially lower half of the main assembly M1000, and the upper case M1002 constitutes a substantially upper half of the main assembly M1000, and they provide a hollow structure, thus providing an accommodating space for various internal structures. Openings are formed in the top and front sides. The front cover (1) M1005 and the front cover (R) M1006 cover the combining portion of the lower case M1001 and the upper case M1002 to improve the ornamental feature of the printer.

One end portion of the sheet discharge tray M1004 is rotatably supported on the lower case M1001, and the opening formed in the front side portion of the lower case M1001 is opened and closed by the rotation of the sheet discharge tray M1004. Therefore, when the recording operation is carried out, the sheet discharge tray M1004 is rotated toward the front side, and the recording sheet dischargeable state is established. The discharged recording sheets P are sequentially stacked on the sheet discharge tray M1004. The discharge tray M1004 accommodates two auxiliary trays M1004*a*, M1004*b*. The auxiliary trays M1004*a*, M1004*b* can be drawn out toward the front, so that recording sheet P supporting area is changeable at three lengths.

One end portion of the access cover M1003 is rotatably supported on the case M1002, and by the rotation thereof, the opening formed in the upper surface is opened and closed. By opening the access cover M1003, the recording head cartridge H1000, ink container H1900 or the like inside the main assembly can be exchanged. Although not shown in the Figure, when the access cover M1003 is opened and closed, a cover opening and closing lever is rotated by a projection provided on the back side of the access cover M1003. The rotational position of the lever is detected by a micro-switch or the like so that opening and closing state of the access cover can be detected.

On a rear part of the upper surface of the case M1002, there are provided a main switch key E001B and a resume key E0019 which are depressible, and also, there is provided a light emitting diode (LED) E0020. When the main switch key E0018 is depressed to enable the recording operation of the printer, the LED E0020 is lighten ON to notify the operator of the operable state. The printer is further provided with various display function for changing lightening, color or the like of a LED E0020 or for actuating a buzzer, upon occurrence of malfunction or the like, or for notifying the operator of the event. When the malfunction is corrected, resume key E0019 is depressed to permit resumption of the recording operation.

(1-2) Recording Operation Mechanism

The description will be made as to the recording operation mechanism provided in the main assembly M1000 of the apparatus. FIG. 1 is a schematic side view of an internal structure of the ink jet printer shown in FIG. 2. Referring to FIGS. 1 and 3, the structure will be described in detail.

The recording operation mechanism comprises an automatic feeding portion M3022 for automatically feeding the recording sheet P into the main assembly M1000 of the apparatus; a feeding portion M3029 for feeding the recording sheet P corning one by one from the automatic feeding portion M3022 to the predetermined recording position and for feeding the recording sheet P from the recording position to the sheet discharge portion M3030; a recording station M4000 carrying a recording head H1001 for effecting the recording on the recording sheet P fed by the feeding portion M3029; and a recovery portion M5000 for recovering or refreshing the recording head H1001.

The mechanisms will be described in detail, respectively.

(1-2a) Automatic Feeding Portion

The automatic feeding portion M3022 functions to feed out, in a horizontal orientation, the recording sheet P which is stacked at an angle of approx 30°–60° relative to the horizontal surface tended to feed the recording sheet P into the main assembly of the apparatus while keeping the substantially horizontal orientation through the unshown feeding opening. It comprises, as shown in FIGS. 1 and 3, a feeding roller M3026, a movable side guide M3024, a pressing plate M3025, ASF base M3023, a separation sheet, M3027 and a separation pad M3028.

The ASF base M3023 substantially constitutes the outer shell of the automatic feeding portion M3022, and is provided at the backside of the main assembly of the apparatus. To the front side of the ASF base M3023, there are mounted a pressing plate M3025 for supporting the recording sheet P at an angle of approx 30°–60° relative to the horizontal surface, and a couple of sheet guides M3024*a*, M3024*b* for guiding the lateral edges of the recording sheet P. One of the guides, that is, the sheet guide M3024*b* is movable in the horizontal direction to meet the different sizes (widths) of the recording sheet P.

A driving shaft M3026*a*, which is interrelated with the ASF motor, is rotatably supported through a transmission gear train (unshown) on the left and right sides of the ASF base M3023, and a plurality of sheet feeding rollers M3026 having different peripheral surface configurations are fixed on the driving shaft M3026*a*.

The recording sheets P stacked on the pressing plate M3025 are supplied to the feeding portion M3029 one by one from the top most one of the stacked recording sheets P by the separation function of the separation pad M3028 and the separation sheet M3027 by rotation of the feeding roller M3026 driven by the ASF motor.

The bottom end of the pressing plate M3025 is elastically supported by a pressing spring (unshown) between the ASF base M3023 and the pressing plate M3025, and therefore, the press-contact force between the feeding roller M3026 and the recording sheet P is kept substantially constant irrespective of the number of stacked recording sheets.

In the feeding path for the recording sheet P from the automatic feeding portion M3022 to the feeding portion M3029, a PE lever M3020 is journaled in a pinch roller holder M3015. The PE lever M3020 is urged in a predetermined direction (in the counterclockwise direction in FIG. 1) by a PE lever spring M3021. The pinch roller holder M3015 is fixed on the chassis M3019 in the form of a metal plate having a predetermined rigidity. When the recording sheet P, separated and supplied from the automatic feeding portion M3022, advances the feeding path, the leading end portion pushes one end portion of the PE lever M3020 to rotate, and an unshown PE sensor detects the rotation of the PE lever M3020, so that the printer detects the event that the recording sheet P enters the feeding path. After the detection of the recording sheet P entering the feeding path, the recording sheet P is fed toward the downstream side through a predetermined distance by the feeding roller M3026. In the feeding operation of the feeding roller M3026, the leading end portion of the recording sheet P abuts the nip formed between the pinch roller M3014 the LF roller M3001 which is provided in the feeding portion, described hereinafter, and is at rest then, so that recording sheet P stops with formations of a predetermined loop. The degree of the loop is approx. 3 mm, for example.

(1-2b) Feeding Portion

As shown in FIGS. 1 and 3, the feeding portion M3029 comprises a LF roller M3001, a pinch roller M3014, a platen M2001 and a platen absorbing material M2016. The LF roller M3001 is supported rotatably on the chassis M3019 by bearings (unshown).

A LF gear M3003 is fixed to one end of the LF roller M3001, and the LF gear M3003 is in meshing engagement with a LF motor gear M3031 fixed on the output shaft of the LF motor through an intermediary LF gear M3012. When the LF motor rotates, the LF roller M3001 rotates through the gear train which is in meshing engagement therewith.

The pinch roller M3014 is mounted to the free end of the pinch roller holder M3015, rotatably supported on the chassis M3019, and is press-contacted to the LF roller M3001 by the pinch roller spring M3016 which is in the form of a coil spring urging the pinch roller holder M3015. When the LF roller M3001 rotates, the pinch roller M3014 is rotated thereby, and the recording sheet P, which is stopped with the formation of the loop, is fed toward the downstream while nipping it between the LF roller M3001 and the pinch roller M3014.

The center of rotation of the pinch roller M3014 is offset by approx. 2 mm toward downstream from the center of rotation of the LF roller M3001 with respect to the sheet feeding direction. By doing so, the recording sheet P, fed by the LF roller M3001 and the pinch roller M3014, is advanced toward the lower left side of FIG. 1, so that recording sheet P is fed along the recording sheet supporting surface M2001*a* of the platen M2001.

In the feeding portion described above, when a predetermined period of time elapses after the stopping of the feeding operation of the sheet feeding roller M3026 in the automatic feeding portion M3022, the LF motor is actuated, and the driving force of the LF motor is transmitted to the LF roller M3001 through the intermediary LF gear M3012 and the LF gear M3003. Then, the recording sheet P, the leading end portion of which is abutted to the nip formed between the LF roller M3001 and the pinch roller M3014, is fed to a record starting position on the platen M2001 by the rotation of the LF roller M3001.

In the feeding operation, the feeding roller M3026 resumes rotation simultaneously with the LF roller M3001, and therefore, the recording sheet P is fed for the predetermined time period downstream by the cooperation of the feeding roller M3026 and the LF roller M3001.

The recording head cartridge H1000 moves with the carriage M4001 which is reciprocable in a direction (main scan direction) crossing (perpendicular, for example) with the feeding direction of the recording sheet P along a carriage shaft M4012 which is fixed on the chassis M3019 at opposite ends. The recording head cartridge H1000 ejects the ink onto the recording sheet P which is at rest at the record starting position effecting printing on the basis of the predetermined image information.

After the recording of the ink image, the recording sheet P is fed by a unit line width, for example, 5.42 mm, by the rotation of the LF roller M3001, and, after the completion of the feeding operation, the carriage M4001 effects the main scan along the carriage shaft M4012. These operations are repeated so that an ink image is formed on the recording sheet P which is on the platen M2001.

The carriage shaft M4012 is mounted on an unshown sheet-head gap adjusting plate (R) at one end and on a sheet-head gap adjusting plate (L) M2012 at the other end, and is urged by a carriage shaft spring M2014. The sheet-head gap adjusting plate is fixed on the chassis M3019 with adjustment to provide an appropriate clearance between the ejection surface of the recording head cartridge H1000 and the recording supporting surface M2001*a* of the platen M2001.

A sheet-head gap adjusting lever M2015 can set either one of two positions (left and right) shown in FIG. 3 (only left side is shown). When the adjusting lever M2015 is moved from the left-hand position to the right-hand position, the carriage M4001 moves away from the platen M2001 by approx. 0.6 mm. When the recording sheet P is a relatively thick one such as an envelope, the adjusting lever M2015 is shifted to the right-hand position, and then the sheet feeding operation of the automatic sheet feeder M3022 is started. When the adjusting lever M2015 takes the right-hand position, the GAP sensor detects the position. When the sheet feeding operation of the automatic sheet feeder M3022 is started for a recording sheet P, the determination is made as to whether the position setting of the adjusting lever M2015 is proper or not based on the output of the GAP sensor. If the result of the determination indicates an improper setting, a message is displayed, or a warning is produced by the buzzer. Thus, start of the recording operation with an inappropriate state is prevented beforehand.

(1-2c) Sheet Discharge Portion

Figure 4:
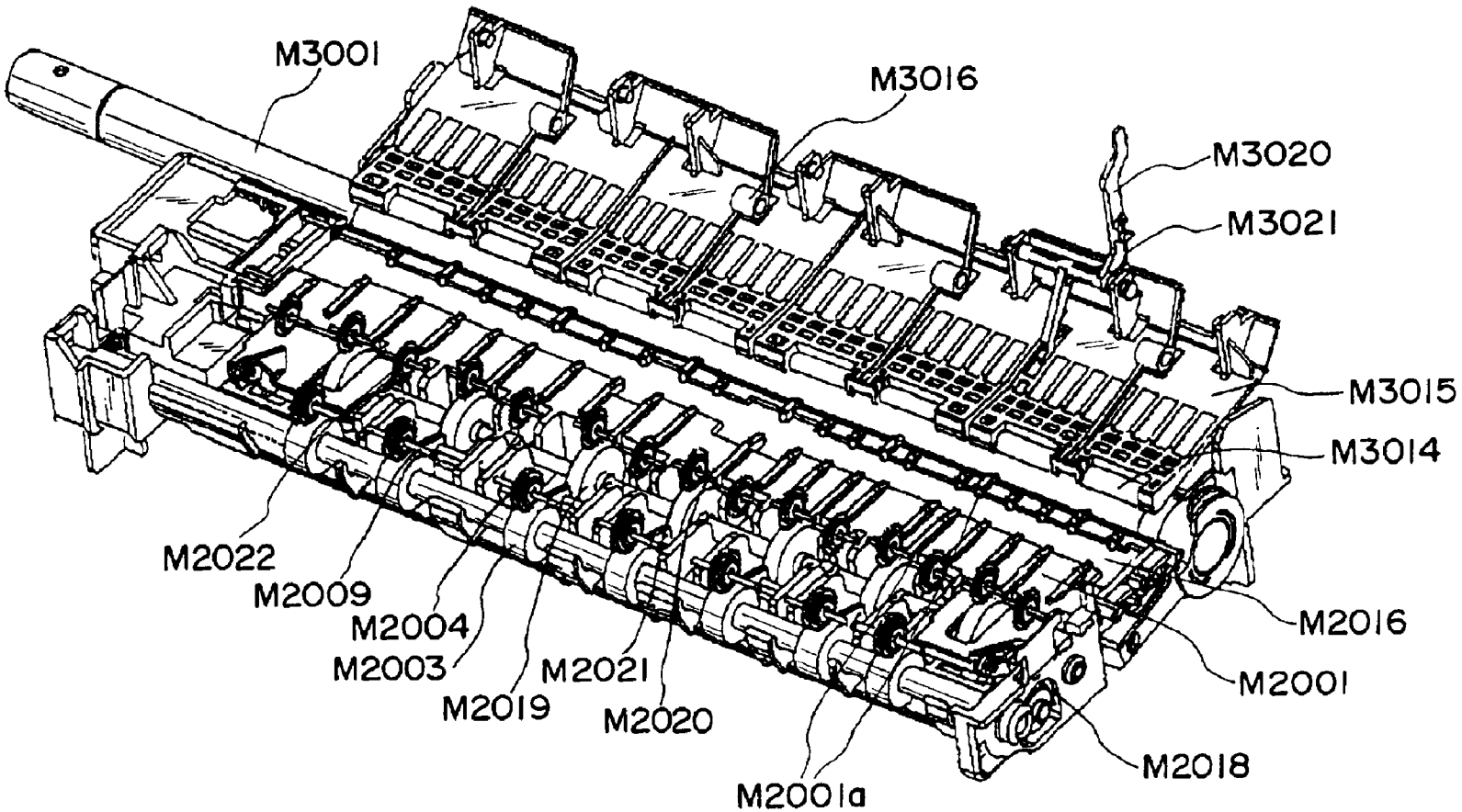
FIG. 4 is a perspective view of an ink jet printer of FIG. 3 from which a part of an internal structure is removed.

FIG. 4 is a perspective view of an ink jet printer of FIG. 3 from which a part of an internal structure, a recording head cartridge H1000 for example, is removed. The sheet discharge portion M3030 comprises:

a first discharging roller M2003 disposed at a downstream side with respect to the feeding direction of the recording sheet P having one end rotatably supported on the platen M2001 and the other end rotatably supported on the chassis M3019 through a first discharging roller bearing M2017; a discharging gear M3013, mounted on one end of the first discharging roller M2003, for transmitting a driving force from the LF motor to the first discharging roller M2003 through the intermediary LF gear M3012; a discharging transmission gear mounted on the other end of the first discharging roller M2003; an intermediary discharging transmission gear M2018 which is in meshing engagement with the discharging transmission gear; a second discharging roller M2019 having an integrally formed discharging transmission gear which is in meshing engagement with the intermediary discharging transmission gear, spur base M2006 on which a spur which will be described hereinafter is mounted; a first spur M2004 which is urged to the first discharging roller M2003 by an urging force of a spur spring shaft M2009 mounted on the spur base M2006 and which is rotated by the discharging roller M2003 to feed the recording sheet P while nipping it with the discharging roller M2003; a second spur M2021 which is rotated by the discharging roller M2019 press-contacted to the second discharging roller M2019 by the urging force of the spur spring shaft M2020 mounted on the spur base M2006 and which feeds the recording sheet P while nipping it with the discharging roller M2019, and a sheet discharge tray M1004 for receiving and stacking the discharged recording sheets P.

The recording sheet P fed to the sheet discharge portion M3030 receives the feeding forces from the first discharging roller M2019, the first spur M2021, the second discharging roller M2003 and the second spur M2004. The center of rotation of the first spur M2004 is offset by approx. 2 mm toward the upstream side with respect to the sheet feeding direction from the center of rotation of the first discharging roller M2003, and therefore, the recording sheet P fed by the first discharging roller M2003 and the first spur M2004 is lightly contacted to the recording sheet supporting surface M2001*a* of the platen M2001 without gap relative to the surface, so that the recording sheet P is properly and smoothly fed.

A first feeding speed provided by the first discharging roller M2019, the first spur M2021, the second discharging roller M2003 and the second spur M2004 and the second feeding speed provided by the LF roller M3001 and the pinch roller M3014 are to substantially equivalent. However, the first feeding speed may be slightly larger than the second feeding speed for the purpose of preventing loosening of the recording sheet P.

The spur base M2006 is provided with a third spur M2022 at a position slightly downstream of the first spur M2021, upstream of the second spur M2004 and between the first spurs M2021 with respect to the widthwise direction of the recording sheet so as not to oppose the first discharging roller M2019. By doing so, an elongation of the recording sheet P resulting from the formation of the image on the recording sheet is accommodated by formation of small waves, by which the recording head H1000 and the recording sheet P are prevented from contacting each other.

When the recording of the ink image on the recording sheet P is completed, and the trailing edge of the recording sheet P departs from between the LF roller M3001 and the pinch roller M3014, the recording sheet P is fed only by the first discharging roller M2019, the first spur M2021, the second discharging roller M2003 and the second spur M2004, and the discharging of the recording sheet P is completed.

(1-2d) Recording Station

The recording station M4000 comprises a carriage M4001 movably supported by the carriage shaft M4021, and the recording head cartridge H1000 which is detachably mountable on the carriage M4001.

As shown in FIG. 3, the recording head cartridge H1000 comprises an ink container H1900 storing the ink, and the recording head H1001 for ejecting the ink supplied from the ink container H1900 through the nozzle in accordance with the information to be recorded or printed. The recording head H1001 is detachably mountable relative to the carriage M4001 which will be described hereinafter, and it is of a so-called cartridge type structure.

The recording head cartridge H1000 shown in FIG. 3 is capable of color recording of photograph-like high image quality. For example, as to the ink container H1900, black, light cyan, light magenta, cyan, magenta and yellow ink containers are independently detachably mountable relative to the recording head H1001.

As shown in FIG. 3, the carriage M4001 is provided with a carriage cover M4002, engaged with the carriage M4001, for guiding the recording head H1001 to the mounting position of the carriage M4001, and a head set lever M4007 engaged with an upper portion of the recording head H1001, such that pressing it sets the recording head H1001 to the predetermined mounting position.

The head set lever M4007 is rotatably mounted to an upper portion of the carriage M4001, and is provided with an unshown head set plate through a spring at the engaging portion relative to the recording head H1001, and the recording head H1001 is urged by the spring force so that it is mounted in place on the carriage M4001.

Another engaging portion of the carriage M4001 relative to the recording head H1001, is provided with a contact flexible print cable (contact FPC), which has a contact portion E001la which in turn is electrically contacted with an unshown contact portion (external signal input contact) of the recording head H1001, so as to enable exchange of various information for the recording operation and supply of the electric power to the recording head H1001.

Between the carriage M4001 and the contact portion E001la of the contact FPC, an unshown rubber or another elastic member is provided, so that contact between the contact portion E001la and the recording head H1001 is assured by the elastic force of the elastic member and the urging force of the head set lever spring. The contact FPC is extended at both of the end portions of the carriage M4001, and one end thereof is securedly nipped by the carriage M4001 using a FPC confining member (unshown), and is connected with the carriage base plate carried on the rear surface of the carriage M4001. The carriage base plate is electrically connected with the main base plate E0014 provided on the chassis M3019 by the carriage flexible flat cable (carriage FFC) E0012.

The other end of the carriage FFC is fixed on the chassis M3019 by the FFC confining member M4028, and is extended through an unshown hole formed in the chassis M3019 to the rear side of the chassis M3019 and then is connected with the main base plate. The carriage base plate is provided with an encoder sensor. By detecting the information on the encoder scale E0005 expanded in parallel with the carriage shaft M4012 between the sides of the chassis M3019, the position of the carriage M4001, the scanning speed thereof or the like can be detected. In this embodiment, the encoder sensor is an optical transmitting type sensor, and the encoder scale E0005 is provided by printing, alternately at predetermined intervals, light blocking portions which block the detecting light from the encoder sensor and light transmitting portions which transmits the detecting light by photographic process on a film of a resin material such as polyester or the like.

The position of the carriage M4001 moving along the carriage shaft M4012 can be detected at desired timings in this manner. That is, the carriage M4001 is abutted to one of the side plates of the chassis M3019 provided on an end of the scanning orbit. The abutment position is used as a reference, and thereafter, with the scanning movement of the carriage M4001, the number of patterns formed on the encoder scale E0005 is counted by the encoder sensor to detect the position.

The carriage M4001 is scanningly moved while being guided by the carriage rail M4013 and the carriage shaft M4012 extended between the lateral sides of the carriage M4001. At the bearing portion of the carriage shaft M4012, a couple of carriage bearings M4029, which are made of sintered metal or the like in which lubricant, such as oil, is impregnated, are integrally molded through insertion molding or the like.

The carriage M4001 is fixed on a carriage belt M4018 extended substantially in parallel with the carriage shaft between the idler pulley M4020 and the carriage motor pulley (unshown). By the rotation of the carriage motor, the carriage motor pulley is rotated to move the carriage belt M4018 in the forward and backward directions, so that the carriage M4001 is moved scanningly along the carriage shaft M4012.

The carriage motor pulley is supported at a predetermined position by the chassis, but the idler pulley M4020 is movably supported on the chassis M3019 together with the pulley holder M4021 and is urged by a spring in the direction away from the carriage motor pulley. In this manner, the carriage belt M4018 extended between the pulleys is subjected always to a proper tension, so that proper slack-free expansion is maintained. To secure the mounting between the carriage belt M4018 relative to the carriage M4001, a carriage belt stop (unshown) is provided.

On the scanning orbit of the spur base M2006 on the carriage M4001, there is provided an ink empty sensor E0006 exposed opposed to the ink container H1900 to detect the remaining amount of the ink in the ink container H1900 of the recording head cartridge H1000 mounted on the carriage M4001. The ink empty sensor E0006 is accommodated in an ink empty sensor cover M4027 having a metal plate to prevent a possible malfunction of the sensor by blocking the external noise.

(1-2e) Recovery Portion

The recovery portion M5000 functions to effect a refreshing or process for the recording head cartridge H1000 and comprises a recovery unit detachably mounted to the main assembly M1000 of the apparatus. The recovery unit includes cleaning means for removing foreign matter deposited on the recording element substrate of the recording head H1001 and refreshing means for normalizing the ink flow paths from the ink container H1900 to the recording element substrate of the recording head H1001.

(1-3) Electric Circuit

Figure 5:
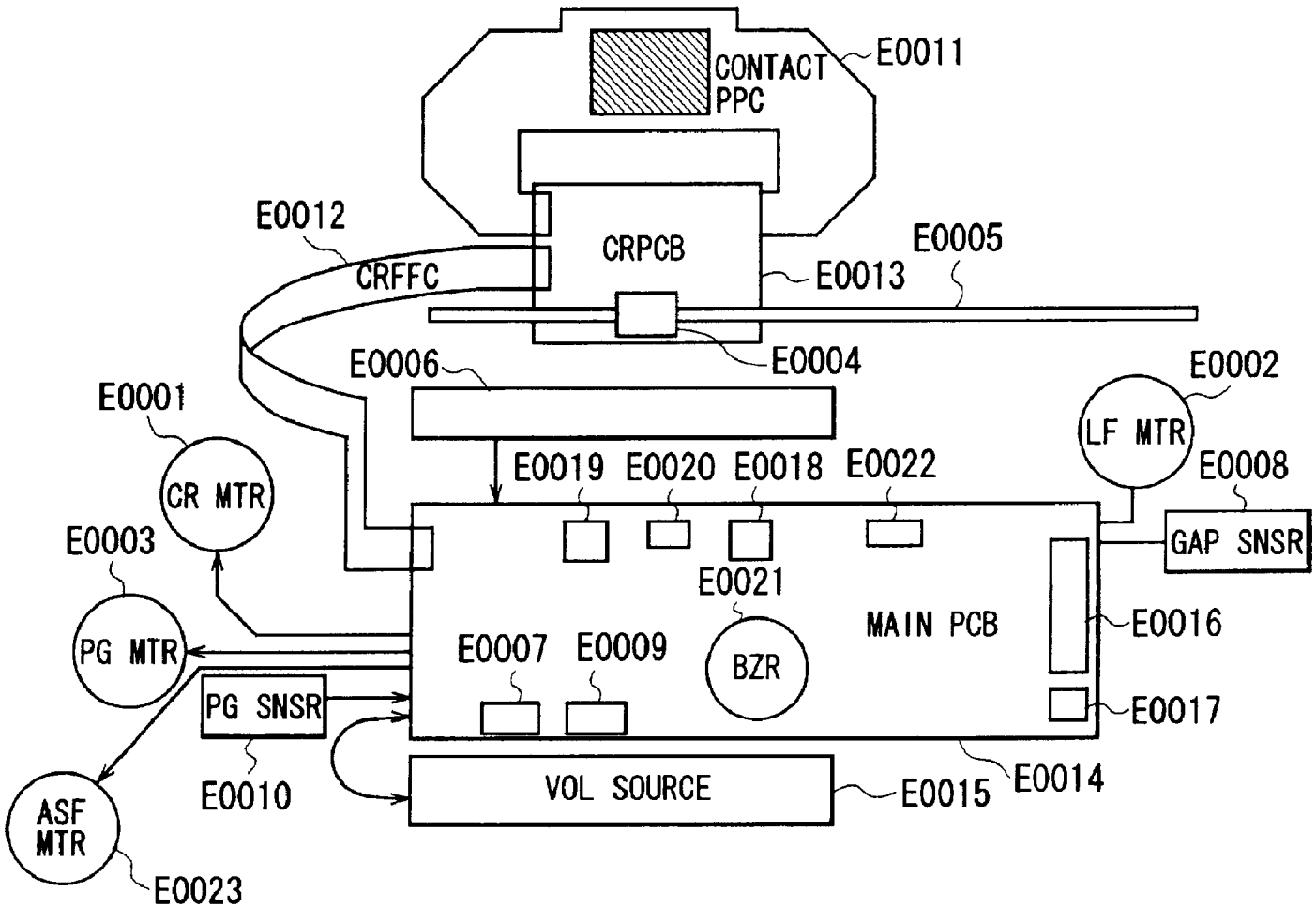
FIG. 5 is a block diagram of a general structure of the electrical circuit of the ink jet printer according to an embodiment of the present invention.

The description will be made as to the electrical circuit structure of the ink jet printer. FIG. 5 is a block diagram schematically showing the general arrangement of the electrical circuit of the above-described ink jet printer.

Referring to FIG. 5, the electrical circuit mainly comprises a carriage base plate (CR PCB) E0013, a main printing circuit board (PCB: Printed Circuit Board) E0014 and a power unit E0015.

The power unit E0015 is connected to the main PCB E0014 to provide various driving voltage sources. The carriage base plate E0013 is a printed board unit, located on the carriage M4001, that functions as an interface for exchanging the signals with the recording head H1001 through the contact flexible print cable (FPC) E0011, functions to detect the change in the positional relation between the encoder scale E0005 and the encoder sensor E0004 on the basis of the pulse signal outputted from the encoder sensor E0004 in accordance with the movement of the carriage M4001, and supplies the output signal to the main PCB E0014 through the flexible flat cable (CR FFC) E0012.

The main PCB E0014 is a printed circuit board unit controlling the drive of various parts of the ink jet printer and comprises the base plate I/O ports for the paper end detection sensor (PE sensor) E0007, ASF sensor E0009, cover sensor E0022 (parallel I/F) E0016, serial interface (serial I/F) E0017, resume key E0019, LED E0020, main switch key E0018, buzzer E0021 and the like. It is connected with the CR motor E0001, LF motor E0002, PG motor E0003, and ASF motor E0023 to control the operation thereof. The main PCB E0014 further comprises connection interfaces relative to the ink empty sensor E0006, GAP sensor E0008, PG sensor E0010, CR FFC E0012 and the power unit E0015.

Figure 6:
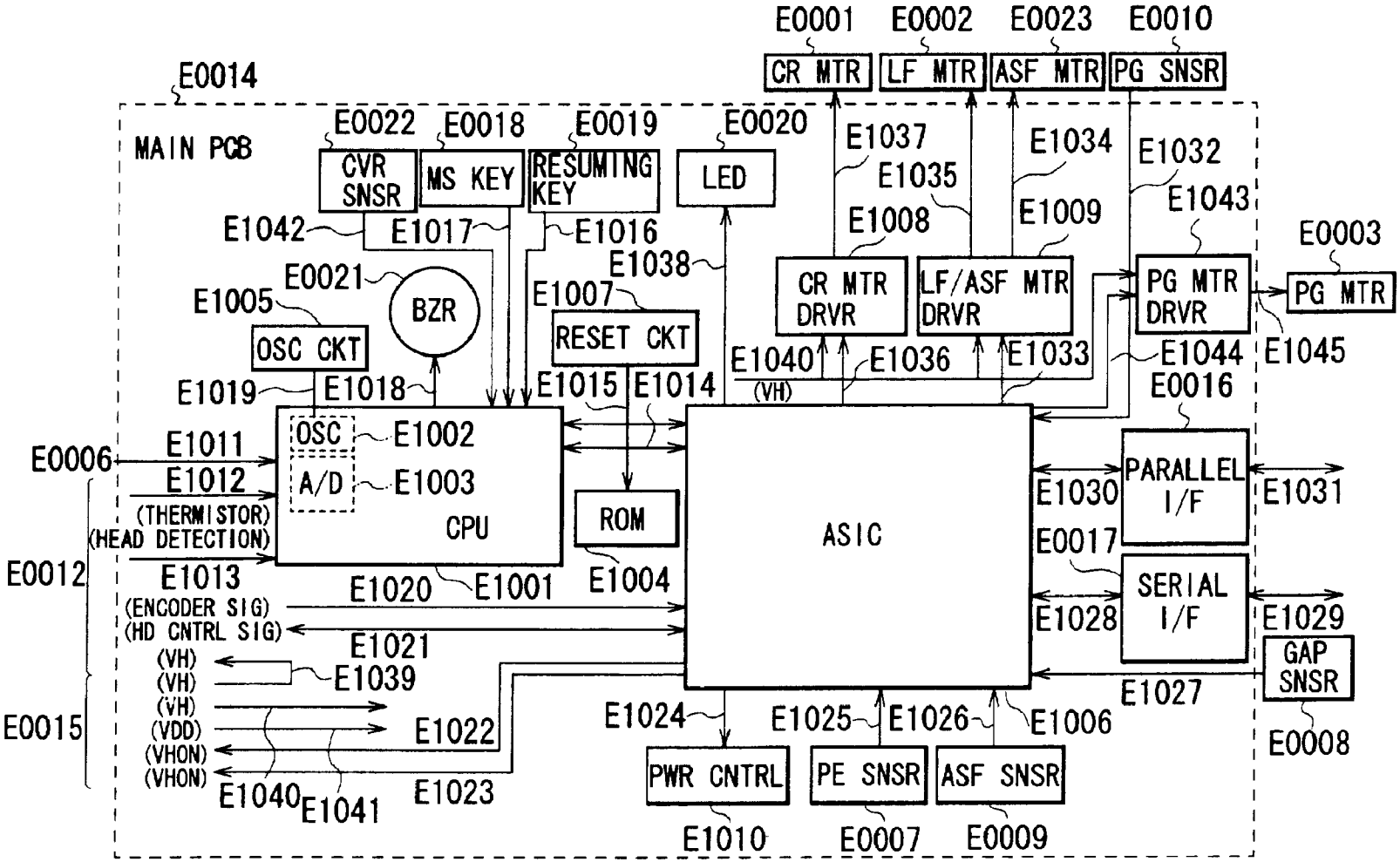
FIG. 6 is a block diagram showing an internal structure of the main PCB shown in FIG. 5.

FIG. 6 is a block diagram illustrating an internal structure of the main PCB. In this Figure, designated by E1001 is a CPU which includes an oscillator (OSC) E1002 therein, and is connected with an oscillation circuit E1005 to generate system clocks on the basis of the output signal E1019 of the oscillation circuit E1005. The CPU E1001 is connected with ROM E1004, and an ASIC (Application Specific Integrated Circuit) E1006 through the control bus E1014. It effects in accordance with the program stored in the ROM thereof a control of the ASIC E1006 and detection of input signals E1017 from the main switch key E0018, an input signal E1016 from the resume key, the cover detection signal E1042, and the head detection signal (HSENS) E1013. It actuates the buzzer E0021 in response to a buzzer signal (BUZ) E1018, detects an ink empty detection signal (INKS) E1011 through the A/D convertor E1003 and detects the thermistor temperature detection signal (TH) E1012. In addition, the CPU E1001 effects various logic processings, condition determinations or the like to control the actuation and driving of the ink jet printer.

The head detection signal E1013 is a head carrying detection signal which is supplied from the recording head cartridge H1000 through the CRFFC E0012, the carriage base plate E0013 and the contact FPC E0011; the ink empty detection signal E1011 is an analog signal outputted from the ink empty sensor E0006; and the thermistor temperature detection signal E1012 is an analog signal from a thermistor (unshown) provided on the carriage base plate E0013.

Designated by E1008 is a CR motor driver which is driven by a motor voltage source (VM) E1040, and generates a CR motor driving signal E1037 in accordance with the CR motor control signal E1036 supplied from the ASIC E1006 to actuate the CR motor E0001. Designated by E1009 is a LF/ASF motor driver which is driven by the motor voltage source E1040, and generates a LF motor driving signal E1035 in accordance with the pulse motor control signal (PM control signal) E1033 fed from the ASIC E1006 to actuate the LF motor E0002 and generates an ASF motor driving signal E1034 to actuate the ASF motor E0023.

Designated by E1043 is a PG motor driver which is driven by the motor voltage source E1040 to generate a PG motor driving signal E1045 in accordance with the pulse motor control signal (PM control signal) E1044 supplied from the ASIC E1006 so as to actuate the PG motor E0003.

Designated by E1010 is a voltage source control circuit which controls electric power supply to various sensors having light emission elements in accordance with the voltage source control signal E1024 from the ASIC E1006. The parallel I/F E0016 functions to transmit the parallel I/F signal E1030 from the ASIC E1006 to the parallel I/F cable E1031 which is connected with an external device and functions to transmit the signal in the parallel I/F cable E1031 to the ASIC E1006. The serial I/F E0017 functions to transmit the serial I/F signal E1028 from the ASIC E1006 to the serial I/F cable E1029 which is connected to an external device and also functions to transmit the signal from the cable E1029 to the ASIC E1006.

From the power unit E0015, a head voltage source (VH) E1039, a motor voltage source (VM) E1040 and a logic voltage source (VDD) E1041, are provided. A head voltage source ON signal (VHON) E1022 and a motor voltage source ON signal (VMON) E1023 are supplied from the ASIC E1006 to the power unit E0015, and the head voltage source E1039 and the motor voltage source E1040 are ON/off controlled. The logic voltage source (VDD) EI041 provided by the power unit E0015 is subjected to a voltage conversion if necessary and is supplied to internal and external various portions of the main PCB E0014. The head voltage source E1039 is smoothed by the main PCB E0014 and is fed out to the CRFFC E0012 and is used for actuating the recording head cartridge H1000.

Designated by E1007 is a resetting circuit which detects a decrease of the logic power source voltage E1040 and supplies a reset signal (RESET) E1015 to the CPU E1001 and the ASIC E1006 to initialize them.

Designated by E1006 is an ASIC 1 chip semiconductor integrated circuit which is controlled by the CPU E1001 through the control bus E1014 to output the CR motor control signal E1036, PM control signal E1033, the voltage source control signal E1024, the head voltage source ON signal E1022, the motor voltage source ON signal E1023 and the like and exchanges the signals with the parallel I/F E0016 and the serial I/F E0017. In addition, it detects the states of the PE detection signal (PES) E1025 from the PE sensor E0007, the ASF detection signal (ASFS) E1026 from the ASF sensor E0009, the GAP detection signal (GAPS) E1027 from the GAP sensor E0008, and the PG detection signal (PGS) E1032 from the PG sensor E0010. The ASIC E1006 transmits data indicative of the states to the CPU E1001 through the control bus E1014 and produces a LED driving signal E1038 on the basis of the input data to control the brightness of the LED E0020.

The ASIC E1006 further detects the states of the encoder signal (ENC) E1020 to generate a timing signal to establish interface relative to the recording head cartridge R1000 in response to the head control signal E1021 to control the recording operation. The encoder signal (ENC) E1020 is an output signal of the CR encoder sensor E0004 supplied through the CRFFC E0012. The head control signal E1021 is supplied to the recording head H1001 through the CRFFC E0012, the carriage base plate E0013 and contact FPC E0011.

(1-4) Basic Operation

Figure 7:
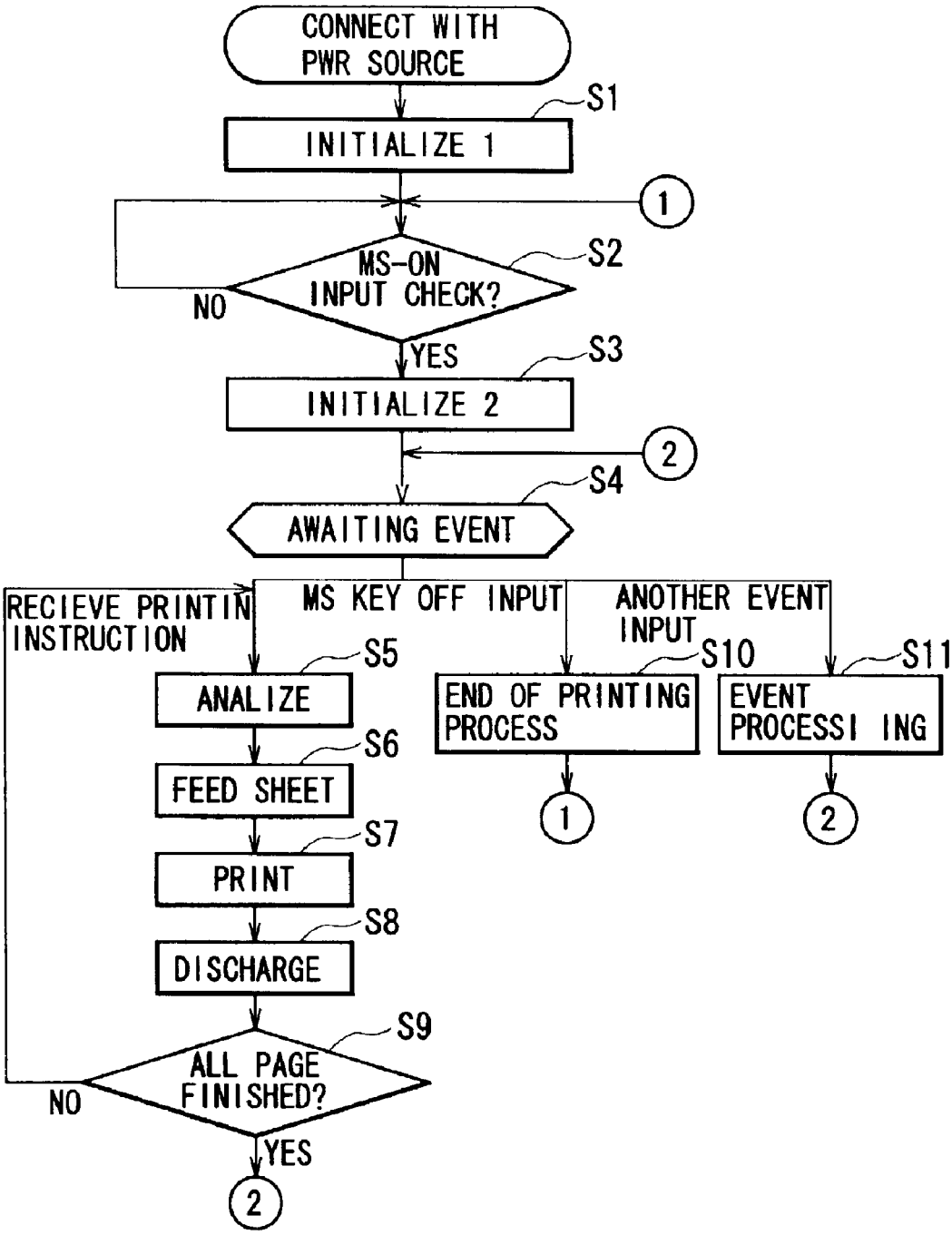
FIG. 7 is a flow chart showing an operation of the ink jet printer according to an embodiment of the present invention.

The detailed description will be made as to the operation of the ink jet printer having the structures described above. FIG. 7 is a flowchart explaining the operations of the ink jet printer.

When the ink jet printer is connected with an AC voltage source, a first initializing process for the printer is carried out at step S1. In the initializing process, the ROM and RAM, and the electric circuit systems are inspected to check whether the printer is electrically in good order.

At step S2, the determination is made as to whether or not the main switch key E0018 provided on the upper case M1002 of the main assembly M1000 of the apparatus is actuated. If so, the operation proceeds to step S3 where a second initializing process is carried out.

In the second initializing process, various driving mechanisms and the head system of the printer are inspected. In particular, the determination is made as to whether or not the printer is properly operable upon the initialization of various motors and the reading of the head information.

Then, the operation proceeds to step S4 where it waits for an event. In particular, it monitors for an instruction event from the external I/F to the printer, a panel key event by the user operation, an internal control event or the like, and, upon an event occurring, the process responsive thereto is carried out.

For example, when the printing instructions event is received from the external I/F at step S4, the operation proceeds to step S5; when the main switch key event is produced by a user operation at the step, the operation proceeds to step S10; and when another event occurs, the operation proceeds to step S11. At step S5, the printing instructions from the external I/F are analyzed to determine the designated sheet material, sheet size, printing quality, sheet feeding method and the like, and the data indicative of the determination is stored in the RAM in the printer, and the operation proceeds to step S6.

Subsequently, at step S6, the sheet feeding is started with the sheet feeding method designated at step S5, the sheet is fed to the record starting position, and the operation proceeds to step S7. The recording operation is carried out at step S7. In the recording operation, the recording data supplied from the external I/F is temporarily stored in the recording buffer. Then, the CR motor E0001 is actuated to start the movement of the carriage M4001 in the scanning direction and to supply the recording data stored in the print buffer to the recording head H1001, and the recording operation is carried out. Upon completion of the recording operation for one set of recording data, the LF motor E0002 is actuated to rotate the LF roller M3001 to feed the sheet in the sub-scan direction. Thereafter, these operations are repeated until the data corresponding to one page supplied from the external I/F are completely printed, and, then, the operation proceeds to step S8.

At step S8, the LF motor E0002 is actuated to rotate the sheet discharging roller M2003 to feed the sheet until the complete discharge of the sheet to the outside of the printer is determined. Upon the completion, the sheet is completely discharged onto the sheet discharge tray M1004*a*.

Then, at step S9, the determination is made as to whether or not the recording operation is completed for all of the pages. If not, the operation returns to step S5, and the above-described operations of steps S5–S9 are repeated. If so, the recording operation is finished. Then, the system returns to step S4 to wait for the next event.

At step S10, the printer finishing process is carried out to terminate the operations of the printer. In particular, the voltage source is enabled to shut down to stop the electric power supply to the various motors and head, the electric power supply is shut down, and the operation proceeds to step S4 where the system again waits for an event.

At step S11, the operations are carried out in response to other events. For example, the processing operations are carried out in response to depression of the panel keys, the externally supplied recovery instructions, internally produced recovery event or the like. After the completion of the process, the system returns to step S4 to wait for the next event.

(2) Electric Discharger

The description will be made as to the discharger used in the ink jet recording apparatus according to this embodiment. The description will be made as to the example of the ink jet printer having the above-described basic structure, referring to the accompanying drawings.

(2-1) Discharging Mechanism

Figure 8:
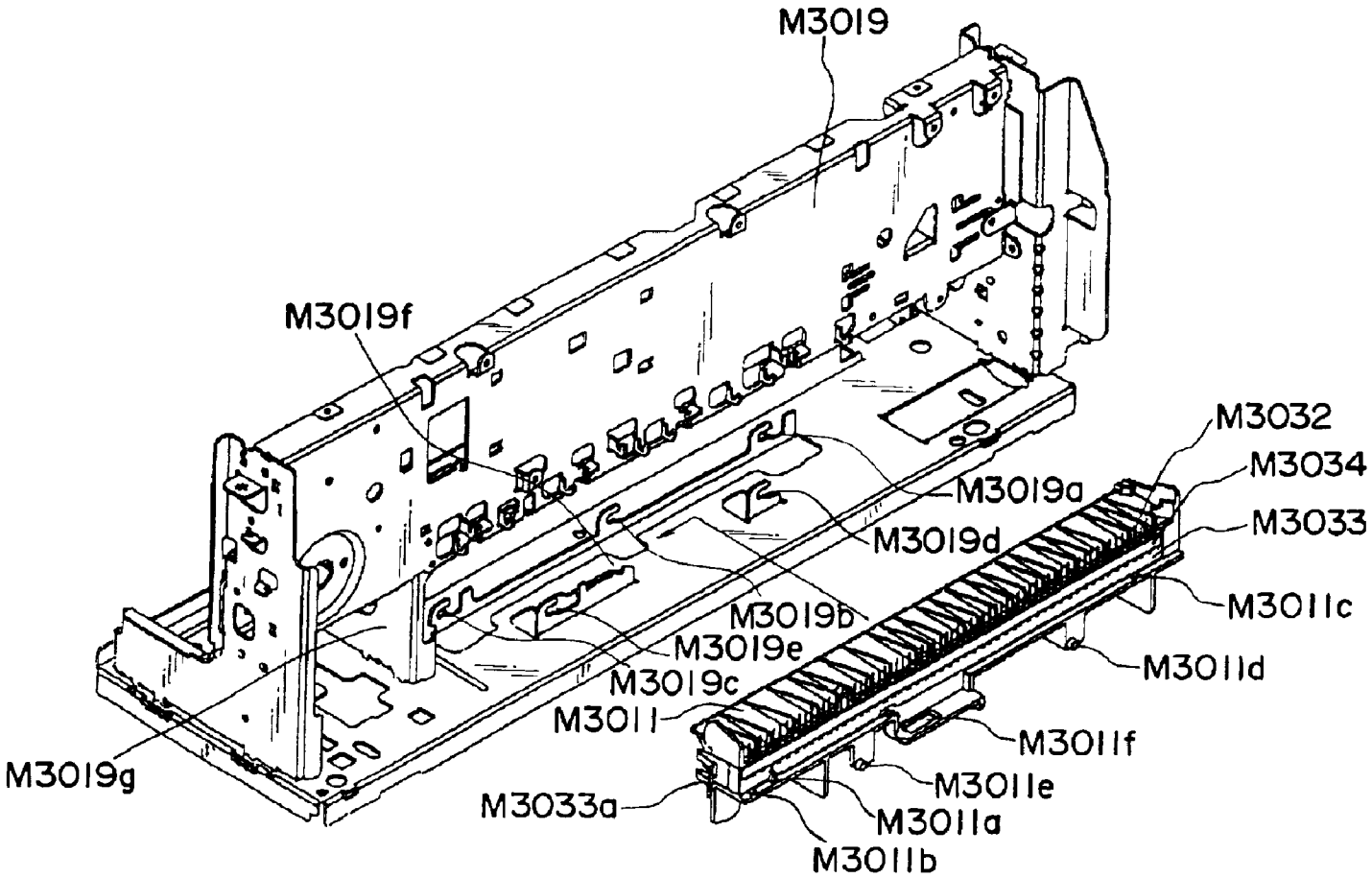
FIG. 8 is a perspective view of discharging means provided in an ink jet printer according to an embodiment of the present invention.
Figure 9:
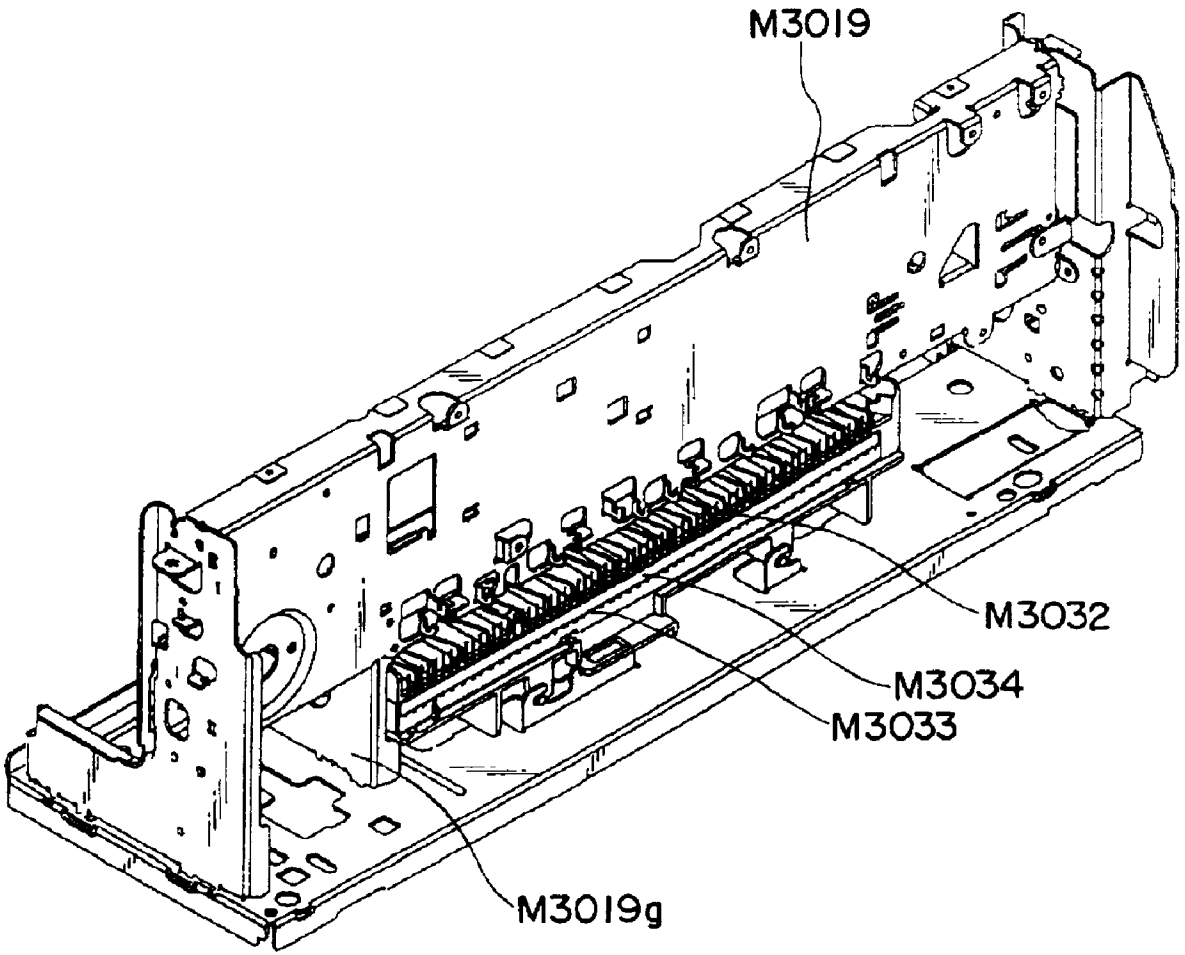
FIG. 9 is a perspective view in which the discharging means shown in FIG. 8 is mounted on the chassis of the main assembly of the printer.

FIG. 8 is a perspective view schematically illustrating a structure of the discharging means used with the ink jet printer according to an embodiment of the present invention. FIG. 9 is a perspective view of the chassis of the main assembly of the printer on which the discharging means shown in FIG. 8 is mounted.

In FIGS. 8 and 9, designated by M3032 is a removable discharging brush. The discharging brush M3032 comprises bundles of 100 fibers each having a diameter of 12 $\mu$m and made of material SUS304, the bundles being placed at 3.2 mm intervals. They are securedly fixed to a metal member M3033 made of a spring material of SUS304 CSP by a thermosetting adhesive tape (unshown) so that fibers are not unbundled, and the ends of the fibers are crimped on the metal member by an aluminum tape M3034 so as to establish the electrical conduction.

Empirically, it has been confirmed that when the resistivity of the discharging brush M3032 is not more than $1\times10^4$ $\Omega\cdot$cm, the backside contamination of the recording sheet P can be avoided. Examples of the material satisfying the condition of the resistivity include SUS fibers, amorphous fibers or the like.

The metal member M3033 is correctly positioned at the positioning portions M3011*a*, M3011*b*, M3011*c*. It is adhered by a double coated tape (unshown) on a sheet guide M3011 formed guiding the recording sheet P discharged from the sheet feeding apparatus M3022 to the feeding portion M3029, such that free ends of the discharging brush M3032 are contacted to the backside of the recording sheet (during recording sheet feeding operation) at a position opposed to the backside of the recording sheet P.

The sheet guide M3011 is slid as indicated by the arrow in FIG. 8 such that unshown positioning bosses (3 position) are engaged with grooved portions M3019*a*, M3019*b*, M3019*c* of the chassis M3019 at a downstream side with respect to the sheet feeding direction and that positioning bosses M3011*d*, M3011*e* are engaged with grooved portions M3019*d*, M3019*e* of the chassis M3019. When the sheet guide M3011 is slid to such an extent that it is stopped, a hook-shaped portion M3011*f* of the sheet guide M3011 is engaged with a stopper configuration portion M3019*f* of the chassis M3019. At this time, a spring portion M3033*a* provided by bending one end of a metal member is pressed by a spring force to a center portion wall plate M3019*g* of the chassis M3019, by which the electrical connection is established between the chassis M3019 and the metal member M3033. Main substrate E0014 is mounted to the chassis M3019 such that GND on the main base plate E0014 can be electrically connected with the chassis M3019. By doing so, the discharging brush M3032 is assuredly grounded electrically.

(2-2) Discharging Effect

The description will be made as to a discharging effect of the discharging brush M3032 in the case of frameless recording.

Figure 10:
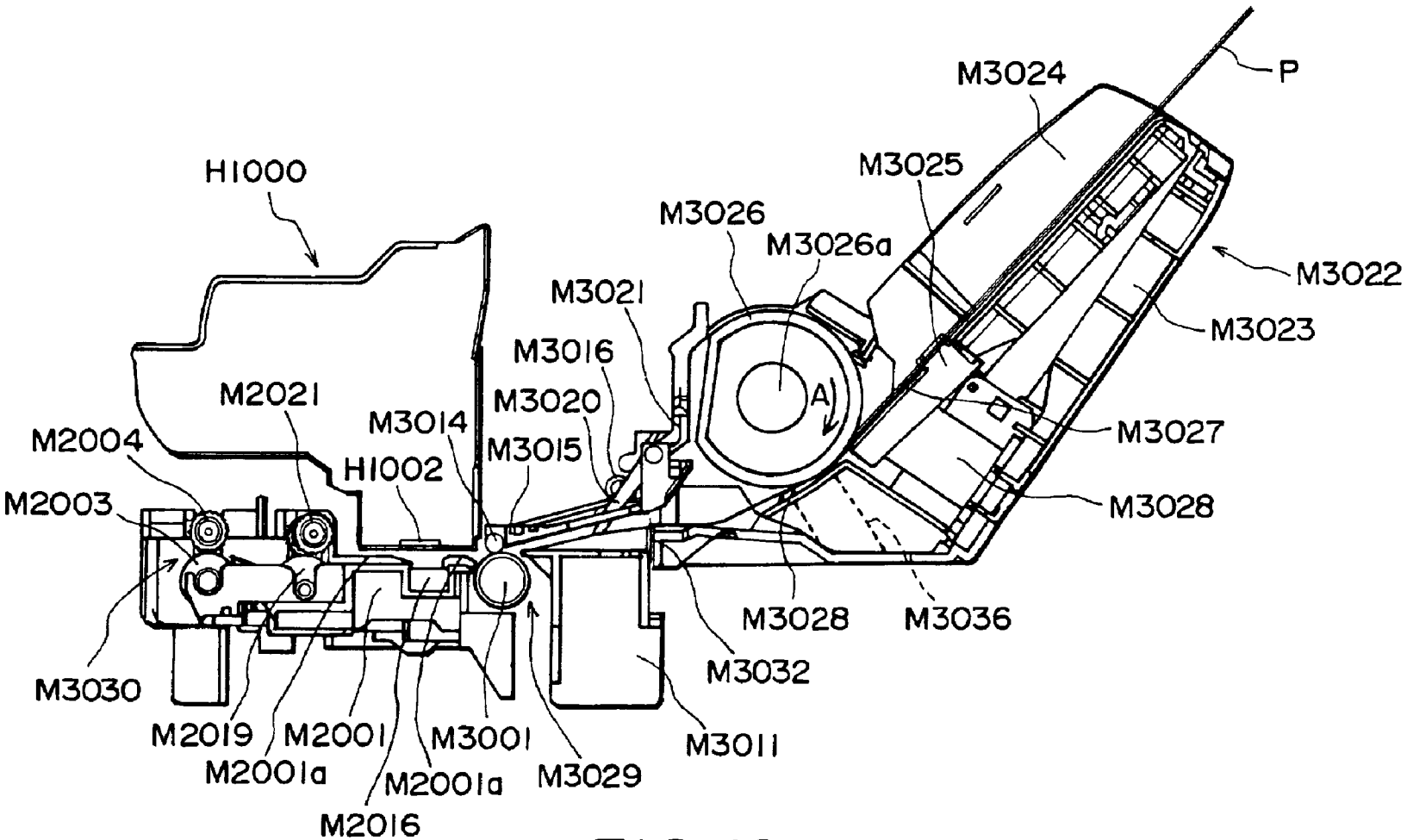
FIG. 10 is a schematic side view of an ink jet printer on which the discharging means shown in FIG. 8 is mounted.
Figure 11:
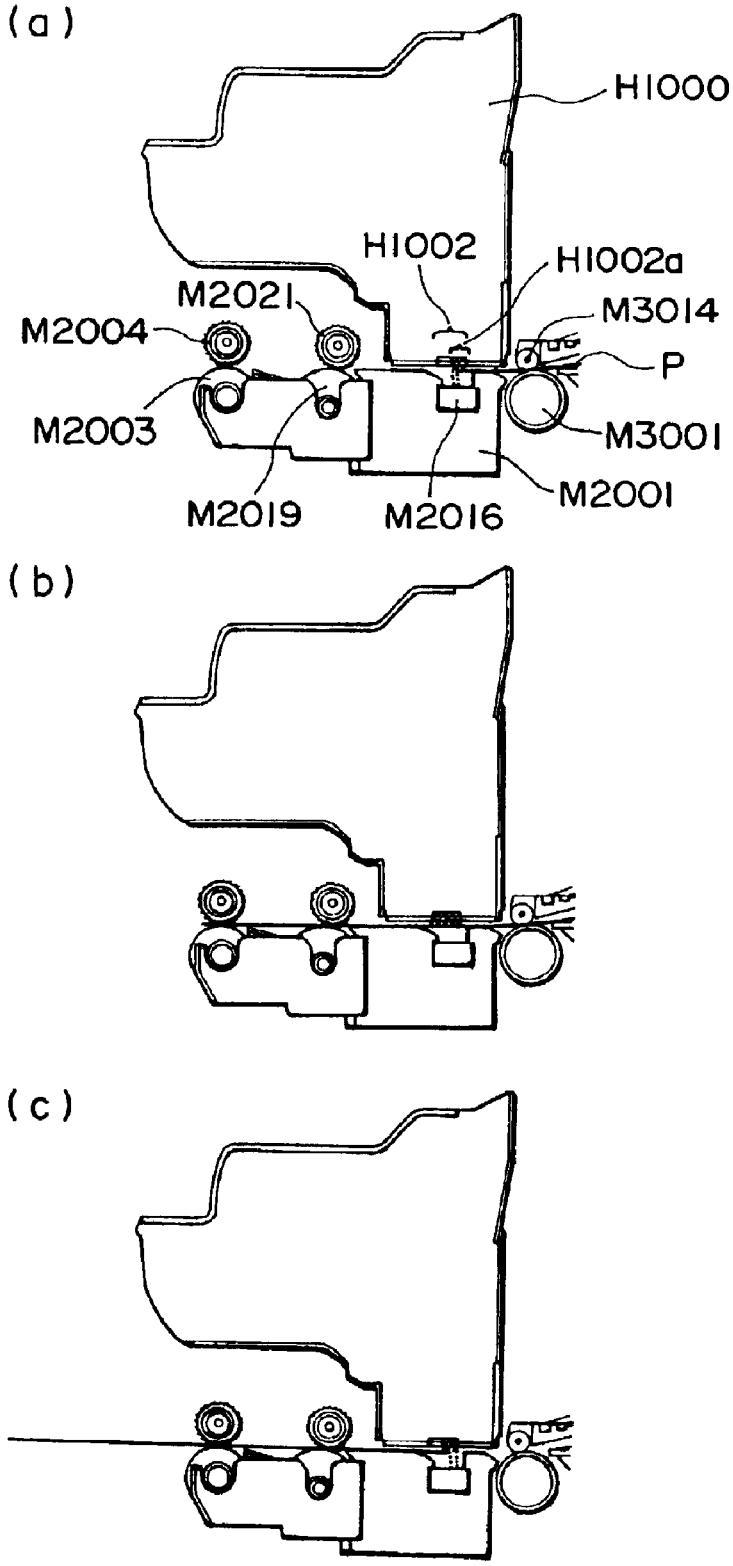
FIG. 11 illustrates frameless printing with the ink jet printer shown in FIG. 10, wherein (a) schematically shows a state in which a leading end of the recording sheet reaches the recording position, (b) schematically shows a state in which the leading end of the recording sheet has passed through the recording position, and (c) schematically shows a state in which a trailing edge of the recording sheet reaches the recording position.
Figure 12:
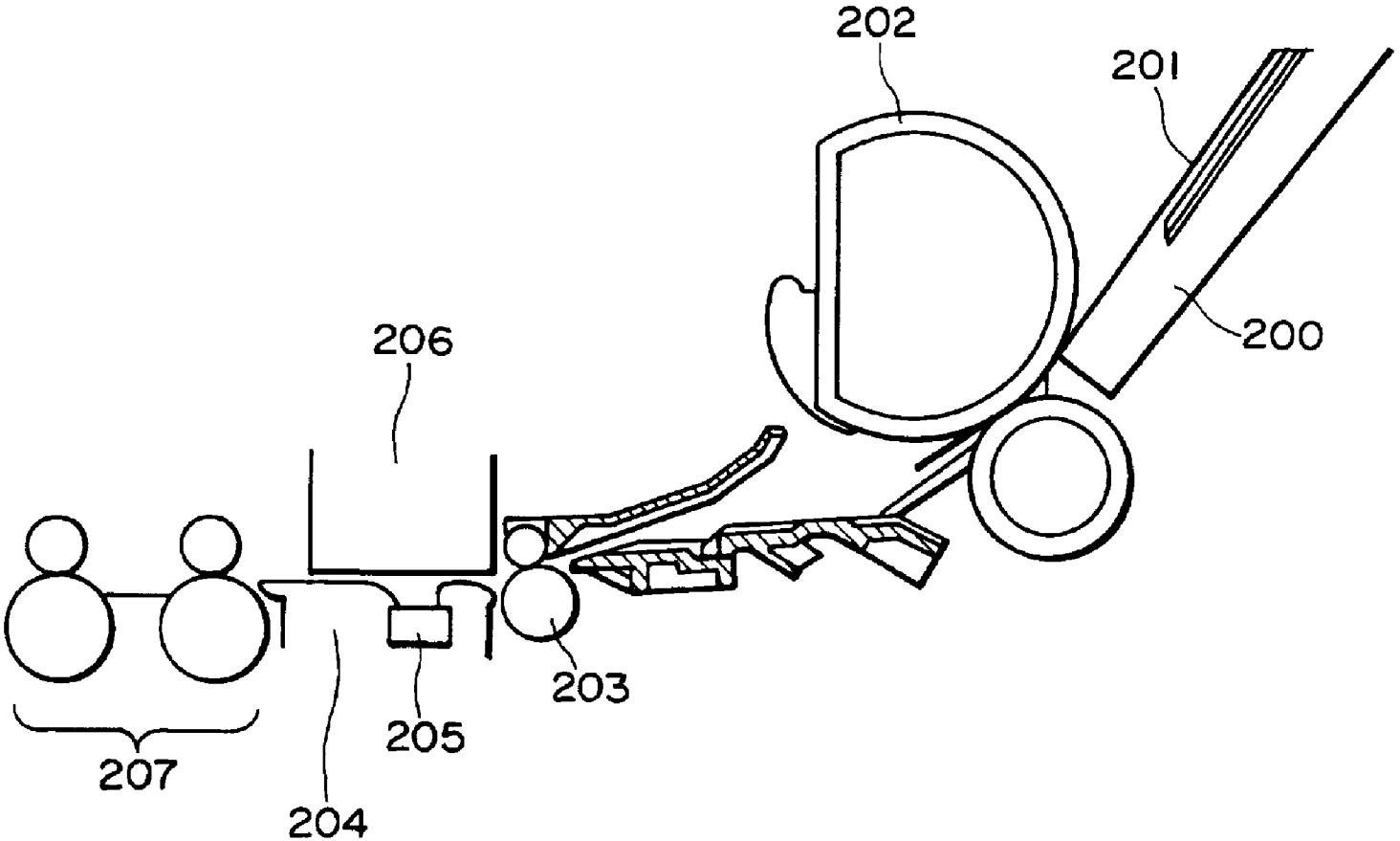
FIG. 12 is a schematic illustration of a conventional separating-type ink jet recording apparatus.

FIG. 10 is a side view schematically illustrating a structure of an ink jet printer containing the discharging means shown in FIG. 8. FIG. 11 illustrates frameless recording operation carried out by the ink jet printer shown in FIG. 10, wherein (a) schematically shows a state in which a leading end of the recording sheet reaches the recording position, (b) schematically shows a state in which the leading end of the recording sheet has passed through the recording position, and (c) schematically shows a state in which a trailing edge of the recording sheet reaches the recording position.

An ink jet printer of this embodiment is capable of effecting frameless printing in which there is no frame or blank area at the four sides, similar to developing and printing a photograph. In particular, data covering an area slightly larger than the size of the recording sheet P are recorded on the sheet such that data are protruded beyond the four sides of the recording sheet P.

In FIG. 10, the platen absorbing material M2016 has a size slightly larger than the width of the recording sheet P with respect to the scanning direction of the carriage and enough to be opposed to a part of the ejection outlets H1002 of the recording head H1000 for ejecting the ink droplets with respect to the recording sheet feeding direction. Thus, it receives the droplets ejected to the area beyond the recording sheet P. However, at the lateral images of regular sizes of L size, post card, 2L size, A4 size, and letter size, the platen absorbing material M2016 exists so as to be opposed to all of the ejection outlets H1002. This is done in order to permit frameless printing at the opposite ends of the recording sheet P. The platen absorbing material M2016 is shorter than the total length of the ejection outlets H1002 of the recording head H1000, because, if it extended over the total length, the area in which the recording sheet support surface M2001*b*, in the form of ribs of the platen M2001, for supporting the backside of the recording sheet P at the recording position cannot be provided, increases. This results in the leading and trailing ends of the recording sheet P becoming lower during the leading and trailing end portions of recording for the recording sheet P, and therefore, image disturbance or contamination due to the contact of the recording sheet P with the platen absorbing material M2016 will result.

The height of the platen absorbing material M2016 is such that it is 3±0.5 mm lower than the surface of the rib M2001*a* of the platen M2001 (4.4±0.5 mm lower than the ejection outlets of the recording head H1000). If it is higher than that, the leading and trailing edges of the recording sheet fall at the time of the leading and trailing end portions of recording, depending on the recording sheets, with a result of contact thereof to the platen absorbing material M2016, and therefore, contamination. If positioned lower than that, a large number of ink droplets ejected to the area outside the recording sheet stall into mists, which will float in the main assembly of the printer.

The separating mechanism for separating the recording sheet P from the automatic feeding portion M3022 normally uses a difference in the frictional force between the adjacent one of the stacked recording sheets P and the frictional force between the feeding roller M3026 and the recording sheet P and a difference between the frictional force between the feeding roller M3026 and the recording sheet P and the frictional force between the recording sheet P and the separation pad M3028. In this embodiment, the same are used. In order to assure separation performance despite the variation in ambient conditions such as the temperature, humidity, sheet passing hysteresis or the like, the sheet feeding roller M3026 is made of chlorinated polyethylene rubber material, and the separation pad M3028 is made of polyurethane material.

When the recording sheet P is fed, the ASF motor E0023 is first actuated to rotate the sheet feeding roller shaft M3026*a* and the sheet feeding roller M3026 through an unshown gear train in the direction indicated by the arrow A in FIG. 10. Then, the pressure plate M3025 which has been pressed down by the cam mechanism (unshown) is released, so that stacked recording sheets P are urged against the sheet feeding roller M3026 by the pressing force of the pressing spring.

The top recording sheets P are roughly separated from the other by the first separation function between the separation sheet M3027 and the sheet feeding roller M3026.

Subsequently, the topmost recording sheet P is singled out by the second separation function provided by the sheet feeding roller M3026 and the separation pad M3028 which is press-contacted to the sheet feeding roller M3026 by the separation pad spring M3036. During separation, the recording sheet P is electrically charged by the friction from the sheet feeding roller M3026, the separation pad M3028, the separation sheet M3027 and/or the other recording sheets. The results of experiments heretofore show that the most significant factor in electrically charging the recording sheet P is the friction relative to the sheet feeding roller M3026 which is made of the chlorinated polyethylene rubber material which is at the significantly remote negative side relative to paper in the series of electrification. The recording sheet P is charged to approx 2.5 (kV) under a low temperature and low humidity ambience.

When the sheet feeding roller M3026 is further rotated, the recording sheet P is fed while contacting to the discharging brush M3032 mounted to the sheet guide M3011. At this time, the potential provided upon the separation is electrically discharged by the discharging brush M3032.

Empirically, the potential provided by the charging upon the separation is discharged to not higher than 150V in this embodiment. By lowering the charging level of the recording sheet P to not higher than 150V, the contamination of the backside of the recording sheet P attributable to the static electricity can be effectively prevented. When the charge amount is higher than 200V, it has been confirmed that contamination of the backside of the recording sheet P is produced due to the static electricity.

The preferable conditions of the discharging brush to lower the charge amount of the recording sheet P to not higher than 150V are that the discharging brush is made of a material having a resistivity of not more than $1\times10^4$ Q, for example SUS (stainless-steel) fibers, amorphous fibers or the like, that free ends of the discharging brush are contacted to the recording sheet P and that the discharging brush is electrically grounded.

In this embodiment, the discharging brush M3032 is disposed downstream of the sheet feeding roller M3026 and upstream of the recording position between the LF roller M3001 and the chassis M3019. By this arrangement, ink droplets in the form of mist produced at the recording position are prevented from depositing directly to the discharging brush M3032. If the ink droplets are deposited on the discharging brush M3032, the ink will contaminate the recording sheet P in the discharging position.

The recording sheet P discharged by the discharging brush M3032 is fed to the position of the PE lever M3020, and the leading edge thereof pushes one end portion of the PE lever M3020. By this, the printer detects the event that recording sheet P reaches the feeding portion.

The recording sheet P having passed through the position of the PE lever M3020 is further fed, and the leading edge abuts the nip formed between the LF roller M3001 and the pinch roller M3014. Here, the LF motor is rotated to rotate the LF roller M3001 through the transmission gear train to feed the recording sheet P to the record starting position with the aid of the pinch roller M3014. When the recording sheet P reaches the record starting position, the frameless printing is carried out by the recording head H1001 on the basis of the recording information.

At the leading end of the recording sheet P, as shown in FIG. 11, (a), only such ejection outlets H1002*a* of the recording head H1001 as face the platen absorbing material M2016 are used, so that recording is effected slightly beyond the leading edge of the recording sheet P.

In the area other than the leading and trailing ends of the recording sheet P, as shown in FIG. 11, (b), the recording is effected using all the ejection outlets H1002*a*, H1002*b*. Here, the ejection outlets H1002*b* are positioned downstream of the ejection outlet H1002*a* adjacent the ejection outlets H1002*a*.

At the rear end of the recording sheet P, as shown in FIG. 11, (c), only the ejection outlets H1002*b* are used so that recording is effected slightly beyond the trailing edge of the recording sheet P. As described in the foregoing, the ink jet recording apparatus of this invention is usable with a usual printing apparatus, copying machine, facsimile machine having a communication system, word processor having a printing station, or an industrial recording device combined with various processing devices.

As described in the foregoing, according to this embodiment, the ink floating adjacent the recording position does not contaminate the back side of the recording sheet, so that high quality prints can be produced.

While the invention has been described with reference to the structures disclosed herein, it is not confined to the details set forth and this application is intended to cover such modifications or changes as may come within the purpose of the improvements or the scope of the following claims.

What is claimed is:

1. An ink jet recording apparatus for effecting recording on recording sheets by ejecting ink from a recording head onto the recording sheets, said apparatus comprising:

a head carrying portion for carrying said recording head, wherein when said recording head effects recording on an end portion of a recording sheet, said recording head ejects at least some of the ink to outside of the end portion of the recording sheet;

a feeding roller for separating and feeding recording sheets one by one from a plurality of the recording sheets;

a conveying roller for conveying a recording sheet fed by said feeding roller to a position where the recording sheet is opposed to said recording head; and discharging means disposed between said feeding roller and said conveying roller with respect to a feeding direction of the recording sheet, said discharging means being effective to decrease an electrostatic charge amount of the recording sheet to a level lower than a predetermined level.

2. An apparatus according to claim 1, further comprising a platen for supporting the recording sheet at a position opposed to said recording head, wherein said platen is provided with an absorbing material for absorbing the ink ejected from the recording head when the recording is effected to the end of the recording sheet.

3. An apparatus according to claim 2, wherein when said recording head effects recording on the end portion of the recording sheet, the recording sheet partly overlaps said absorbing material.

4. An apparatus according to claim 3, wherein when said recording head effects recording on the end portion of the recording sheet, said platen supports the recording sheet so that the recording sheet does not contact the absorbing material.

5. An apparatus according to claim 1, wherein the predetermined level is 150V at the position opposed to the recording head.

6. An apparatus according to claim 1, wherein said discharging means is in the form of a discharging brush.

7. An apparatus according to claim 6, wherein said discharging brush is contacted to the back side of the recording sheet.

8. An apparatus according to claim 6, wherein the discharging brush has a resistance of $1\times10^4$ Ω·cm.

9. An apparatus according to claim 8, wherein the discharging brush is made of stainless steel fiber.

10. An apparatus according to claim 8, wherein the discharging brush is made of amorphous fiber.

11. An apparatus according to claim 6, wherein the discharging brush is electrically grounded.

12. An apparatus according to claim 11, further comprising an electrically groundable chassis, and a metal spring material fixed while the discharging brush is maintaining electrical conduction, wherein the discharging brush is electrically grounded by a part of the metal spring material press-contacted to the chassis.

13. An ink jet recording apparatus for effecting recording by ejecting ink onto a recording sheet from a recording head, comprising:

a head carrying portion for carrying the recording head;

first feeding means for separating a single recording sheet from a stack of recording sheets and feeding the recording sheet;

second feeding means for feeding the recording sheet fed by said first feeding means to a position opposed to the recording head;

a supporting member for supporting said head carrying portion, and defining a segmented recording operation region and a feeding means region, wherein the recording head effects recording on the recording sheet in the recording operation region, and at least said second feeding means is disposed in the feeding means region; and discharging means disposed at a position between said first and second feeding means with respect to a feeding direction of the recording sheet;

wherein said discharging means electrically discharges the recording sheet such that an electrostatic charge amount is not more than a predetermined level.

14. An apparatus according to claim 13, further comprising a platen for supporting the recording sheet at a position opposing the recording head.

15. An apparatus according to claim 14, wherein said discharging means is contactable to a side of the recording sheet that is opposite a side thereof on which the recording head effects recording.

16. An apparatus according to claim 15, wherein when the recording is effected at an end portion of the recording sheet, the sheet is overlapped with a part of an absorbing material.

17. An apparatus according to claim 16, wherein when the recording is effected, said platen supports the sheet such that sheet is out of contact with the absorbing material.

18. An apparatus according to claim 13, wherein said supporting member comprises a plate-like member extending substantially perpendicular to the sheet feeding direction.

* * * * *